US009242349B2

(12) United States Patent
Battenfeld

(10) Patent No.: US 9,242,349 B2
(45) Date of Patent: Jan. 26, 2016

(54) CRIMPING PLIERS

(71) Applicant: WEZAG GmbH Werkzeugfabrik, Stadtallendorf (DE)

(72) Inventor: Kurt Battenfeld, Ebsdorfergrund/Wittelsberg (DE)

(73) Assignee: WEZAG GMBH WERKZEUGFABRIK, Stadtallendorf (DE)

( * ) Notice: Subject to any disclaimer, the term of this patent is extended or adjusted under 35 U.S.C. 154(b) by 0 days.

(21) Appl. No.: 14/606,362

(22) Filed: Jan. 27, 2015

(65) Prior Publication Data

US 2015/0217429 A1 Aug. 6, 2015

(30) Foreign Application Priority Data

Feb. 6, 2014 (EP) ..... 14154206

(51) Int. Cl.

| | |
|---|---|
| ***H01R 43/042*** | (2006.01) |
| ***B25B 7/12*** | (2006.01) |
| ***B21J 7/16*** | (2006.01) |
| ***B25B 7/16*** | (2006.01) |
| ***B25B 27/14*** | (2006.01) |

(52) U.S. Cl.

CPC . *B25B 7/123* (2013.01); *B21J 7/16* (2013.01); *B25B 7/12* (2013.01); *B25B 7/16* (2013.01); *B25B 27/146* (2013.01); *H01R 43/042* (2013.01); *H01R 43/0424* (2013.01)

(58) Field of Classification Search

CPC ..... B21J 7/16; B25B 7/12; B25B 7/123; H01R 43/042

USPC ..... 72/409.01, 409.02, 409.08, 409.11, 72/409.12, 409.13, 409.19, 121, 399, 402; 81/90.1, 303, 313

See application file for complete search history.

(56) References Cited

U.S. PATENT DOCUMENTS

| | | | | |
|---|---|---|---|---|
| 3,199,335 | A * | 8/1965 | Holmes et al. | 72/409.01 |
| 3,713,322 | A * | 1/1973 | Fischer | 72/409.09 |
| 4,381,661 | A | 5/1983 | Wiener et al. | |
| 5,408,904 | A | 4/1995 | Neff | |
| 6,176,116 | B1 * | 1/2001 | Wilhelm et al. | 72/409.12 |
| 6,889,579 | B1 * | 5/2005 | Brown | 81/90.2 |
| 8,474,299 | B2 * | 7/2013 | Lutze et al. | 72/409.12 |
| 8,613,210 | B2 * | 12/2013 | Wagner et al. | 72/20.1 |

FOREIGN PATENT DOCUMENTS

| | | |
|---|---|---|
| DE | 31 09 289 C2 | 8/1987 |
| DE | 195 07 347 C1 | 9/1996 |
| DE | 197 09 639 A1 | 9/1998 |
| DE | 198 58 719 A1 | 6/2000 |

(Continued)

*Primary Examiner* — David B Jones

(74) *Attorney, Agent, or Firm* — Thomas | Horstemeyer, LLP

(57) ABSTRACT

The present invention relates to crimping pliers in particular used for forming at least three recesses at a contact element housing an electrical conductor.

The inventive crimping pliers (1) comprise a toggle lever drive (6). The toggle lever drive (6) is built with an elastic pressure lever (18). The pressure lever (18) is preferably built with an offset or cranking (33) so that with the application of a longitudinal force the pressure lever (18) is biased by a bending. The flexible design of the pressure lever (18) provides a variable crimping stroke (in particular also in connection with a forced locking mechanism (28)) for different dimensions of the contact elements to be crimped.

24 Claims, 4 Drawing Sheets

(56) References Cited

FOREIGN PATENT DOCUMENTS

| | | | |
|---|---|---|---|
| DE | 101 40 270 | B4 | 9/2004 |
| DE | 10 2005 003 615 | B3 | 9/2006 |
| EP | 0 158 611 | B1 | 7/1990 |
| EP | 0 732 779 | B1 | 2/1996 |
| GB | 2 072 081 | A | 9/1981 |

* cited by examiner

CRIMPING PLIERS

CROSS REFERENCE TO RELATED APPLICATIONS

This application claims priority to co-pending European Patent Application No. EP 14 154 206.8 entitled "Presszange", filed Feb. 6, 2014.

FIELD OF THE INVENTION

The invention relates to crimping pliers used for crimping a workpiece. The crimping pliers are e.g. used for deforming the outer surface or circumference of a workpiece or contact element, in particular for forming a plurality of notches into the circumference and/or for crimping of wire end sleeves, contact sleeves or cable shoes upon an electrical conductor and the like.

BACKGROUND OF THE INVENTION

EP 0 732 779 B1 discloses crimping pliers for crimping a wire end sleeve with a conductor with removed insulation. The crimping pliers comprise a pliers head. The pliers head is built with a base body. The base body is rigidly connected with a rigid hand lever. A pivoting ring is pivotable with respect to the base body around a die axis. In the region of its inner ring the pivoting ring comprises radial recesses building a kind of spline profile. Six crimping plugs are regularly distributed at locations around the die axis. The die plugs are each pivotably linked with a pivoting bolt held by the base body. In the end region facing away from the die the crimping plugs are each housed in the recesses of the spline-profiled recesses of the pivoting ring. The pivoting movement of the pivoting ring causes a common pivoting of the crimping plugs. The die is built from the radial inner die surface of the crimping plugs and is almost closed in the circumferential direction. The cross-sectional area of the die reduces with the pivoting movement of the pivoting ring and the caused rotation of the crimping plugs so that the crimping of the wire end sleeve is caused. The actuation of the pliers head by causing a relative pivoting movement of the pivoting ring with respect to the base body is done by a drive bolt or pivoting bolt linked with the pivoting ring. The drive bolt or pivoting bolt is a component of a pivoting link. By the pivoting link an end region of a movable hand lever is linked at the pivoting ring. At a location with a small distance from the afore mentioned pivoting link a pressure lever is linked at the movable hand lever by another pivoting link. This pivoting link builds a toggle joint. In the end region facing away from the toggle joint the pressure lever is linked at the fixed hand lever. For building this link, the pressure lever forms a bearing sphere which is housed in a bearing shell formed by the rigid hand lever. A return spring acting in opening direction of the crimping pliers is with one spring base directly linked at the pivoting ring, whereas the other spring base of the return spring is linked at the fixed hand lever. Remote from the connecting region between the toggle joint and the bearing sphere the pressure lever comprises a circumferential section comprising teeth which cooperate with a latching element. The latching element is pivotably linked at the movable hand lever. The latching element is biased towards an equilibrium position by a spring acting between the latching element and the movable hand lever. With the teeth of the pressure lever and the latching element a forced locking mechanism is built. Once arriving at a crimping step of the crimping pliers the forced locking mechanism guarantees that the reached crimping step is also secured when reducing the actuation forces applied upon the hand levers wherein no opening movement of the pliers head takes place. Instead, an opening movement is only possible if the pressure lever has completely passed the predetermined overall crimping stroke.

EP 0 732 779 B1 describes the problem that generally for crimping pliers with a forced locking mechanism the forced locking mechanism defines an end state which correlates with a predetermined end size of the die. When crimping workpieces of different sizes (e.g. due to tolerances from the manufacturing of the workpiece or due to the use of different types of workpieces) with the crimping pliers, the crimping process ends with the afore mentioned predetermined end size of the die. Accordingly, independent from the size of the workpiece the overall crimping stroke is always the same, whereas the effective crimping forces depend on the size of the workpiece. This might in some case deteriorate the uniformity and quality of the crimping result. It is also possible that damages up or even a breakage of components of the crimping pliers result which is due to an overload.

On this background, EP 0 732 779 B1 proposes not to rigidly support the bearing stud of the pressure lever. Instead, according to EP 0 732 779 B1, in the connecting region between the base body and the bearing shell the fixed hand lever is flexible. Dependent from the amount of the effective crimping force, the bearing shell is deformed. The deformation of the bearing shell provides a movement of the hand levers towards each other without a pivoting movement of the pivoting ring relative to the base body without any further reduction of the cross-sectional area of the die. Accordingly, for a larger workpiece according to EP 0 732 779 B1 it is possible to arrive at an end state of the forced locking mechanism. Here, in the beginning in a crimping stroke the crimping plugs move towards each other in an extent which is smaller than the extent of the movement of the crimping plugs towards each other for a smaller workpiece. An additional movement of the hand levers towards each other then does not result in an additional movement of the crimping plugs towards each other but in an elastic deformation of the fixed hand lever. Also a superposition of the movement of the crimping plug and the deformation of the fixed hand lever is possible.

For providing a sufficient elasticity for the support of the bearing shell, the fixed hand lever is built with two hand lever parts which are connected with each other in an end region having a V-shape. In another end region one hand lever part builds the bearing shell, whereas the end region of the other hand lever part is fixedly linked with the base body of the pliers head or builds the same. The two hand lever parts are flexible. For this purpose, the hand lever part forming the bearing shell is tapered towards the bearing shell, whereas the other hand lever part comprises a constriction or narrowing having an extent so that the constriction or narrowing is elastically deformable by applied hand forces. The rigid connecting region of the two V-shaped hand lever parts has to be designed such that in this end region the actuation of the crimping pliers is possible by the hand of the user. According to EP 0 732 779 B1, the connection of the two hand lever parts is provided by a connection with a positive lock via a transverse bolt and knops embossed in longitudinal direction. The effect caused by the elastic support of the pressure lever in the region of the bearing shell is in EP 0 732 779 B1 also denoted as "force-displacement-compensator".

Further prior art concerning a pliers head with an actuation of more than two crimping plugs by a pivoting movement of a pivoting ring is disclosed in the patent publications DE 101 40 270 B4 and DE 10 2005 003 615 B3. However, in these patent publications the crimping plugs are not pivotably held at the base body but are guided for a displacement in radial inner direction relative to the base body. Here, a differing drive kinematic is used for the actuation of the pliers head.

Also EP 0 158 611 B1 proposes to elastically support the linking point of the pressure lever at the fixed hand lever. This is done by the arrangement of a bearing bolt supporting the pressure lever in an elongated hole of the fixed hand lever. The bearing bolt is able to move along the elongated hole under the bias of a spiral spring.

DE 31 09 289 C2 also proposes to elastically support a pressure lever (here for crimping pliers with scissor-like crimping jaws). In this case, the elastic support of the pressure lever is provided by a narrowing in the form of a slot of the hand lever in the region of the linking point for the pressure lever. The slot results in a bifurcation of the fixed hand lever. In the region of the bifurcation the material of the fixed hand lever comprises a reduction of the cross-section. The reduction of the cross-section causes an elastic deformation of the fixed hand levers for the effective crimping forces.

SUMMARY OF THE INVENTION

The inventive crimping pliers comprise a pliers head. The pliers head is built with a base body and an actuation body. For producing a crimping movement of crimping plugs it is possible to move the actuation body relative to the base body. A fixed hand lever is rigidly linked with the base body. A movable hand lever is (indirectly or directly) linked at the actuation body. The movable hand lever is pivotably linked with a pressure lever by a toggle joint wherein the pressure lever is pivotably linked at a fixed hand lever.

The invention proposes that (differing from the above describes prior art) the compliancy or elasticity of the drive kinematic of the crimping pliers is not provided by designing a linking point of the pressure lever at the fixed hand lever with an elastic compliancy (cp. EP 0 732 799 B1, EP 0 158 611 B1 and DE 31 09 289 C2). Instead, the pressure lever itself is elastically. By this design it is possible to provide a simplification compared to the embodiments known from the prior art. This is due to the fact that it is not necessarily required that

- the hand lever is built with two hand lever parts which are connected with each other in a V-shape and which are each elastically and which have to be provided with a narrowing (as this is the case according to EP 0 732 799 B1),
- there is a guidance of the pivot bearing for the pressure lever in an elongated hole under bias of a spiral spring (as this is the case according to EP 0 158 611 B1), or
- the fixed hand lever has to be designed with a purposeful weakening or bifurcation by the provision of a slot (as being the case according to DE 31 09 289).

Instead, there are no specific requirements for the design of the fixed hand lever when dimensioning the stiffness of the same. According to the invention the compliancy and a force-displacement-compensator might be provided (at least also) by the choice of

- the length of the pressure lever,
- the material of the pressure lever and its stiffness,
- the cross-section of the pressure lever and the change of the cross-section and/or
- the geometry of the pressure lever.

It is also possible that for differing crimping pliers pressure levers with different elasticities can be used, whereas it is not necessary to change other parts of the crimping pliers (as in particular the rigid hand lever). In this manner, within the frame of the invention it is also possible to provide crimping pliers for differing uses only by an exchange of the pressure lever.

Generally, any construction of the pliers head and the actuation kinematic might be used for the crimping pliers. It is also possible that in the pliers head only two crimping plugs (and in this case in some cases also only two die halves) are present which are held at the base body and the actuation body or which are integrally built by the same. For a specific application of the inventive measures, the crimping pliers comprise at least three crimping plugs. The crimping plugs are linked at the base body of the pliers head in a way such that a movement of the crimping plugs in radial inner direction is possible. This movement might be a pivoting movement around a pivot bearing with fixed location at the base body (cp. EP 0 732 779 B1) or a radial displacement (cp. DE 10 2005 003 615 B3, DE 10 2011 052 967 B4 and DE 101 40 270 B4). In this case the actuation body is built by a pivoting ring being pivotable relative to the base body. The pivoting ring comprises grooves or cam surfaces by which it is possible to commonly move the crimping plugs in radial inner direction with a pivoting movement of the pivoting ring.

The pressure lever might be objected to any mechanical bias provided that the mechanical bias results in a deflection. It is e.g. possible that the pressure level is elastically in longitudinal direction so that with the bias of the pressure level the pressure level changes its length due to the effective normal stresses. For one particular embodiment of the invention, the pressure lever is built with an offset or cranking. The cranked design of the pressure lever leads to the result that a longitudinal force (which is effective at the linking points of the pressure level at the two hand levers and which is directed to the longitudinal axis connecting the two afore mentioned linking points with each other) does not result in a pure bias of the pressure level with normal stresses. Instead, the cranked design of the pressure lever results in the bias of the pressure lever with a bending moment. Here, the bias with the bending moment is dependent on the amount of cranking or offset of the pressure lever. By the choice of the cross-section of the pressure lever, of the young's modulus of the pressure lever, the curvature and the cranking and the geometrical moment of inertia of the pressure lever, it is possible to define the elasticity of the pressure lever by constructive measures. It is also possible that by the provision of a buckling behavior by constructive measures (wherein the buckling behavior results from a superposition of a bias by bending and a bias with a longitudinal force due to the cranking) an elasticity is defined (in some cases also with the provision of a nonlinear elasticity). It is also possible that the inventive elasticity of the pressure lever results from a superposition of different types of mechanical biases.

Generally, it is possible that there is no automatic return of the crimping pliers from a reached closed state so that it is necessary to manually cause the return. In the case that an automatic return in opening direction is intended, this might be provided by a return spring which directly or indirectly biases the hand levers in opening direction. Here, generally the return spring might be located between any components and at any places of the actuation kinematic. For one particular embodiment of the invention, a spring base of the return spring is supported in the region of the toggle joint at the movable hand lever (in particular at the toggle joint itself). The other spring base of the return spring is supported at the fixed hand lever.

It is possible that the crimping pliers are built without any forced locking mechanism so that the actuation of the crimping pliers requires increased demands concerning the elaborateness of its manipulation and the user terminates the crimping process by observation of the passed crimping stroke and/or when arriving at an estimated hand force. For a preferred embodiment the inventive crimping pliers are equipped with a forced locking mechanism for guaranteeing the elaborateness of execution of the crimping process up to a defined end state. Preferably, according to the invention, the end state is both dependent from the achieved relative movement of the actuation body relative to the base body (so the overall crimping stroke of the crimping plugs) as well as from the elastic deflection of the elastic pressure lever. Here, there might be a dependency between the two afore mentioned influencing effects which is defined by constructive measures.

According to another proposal of the invention, a rod extends through the return spring. The rod might serve as a guidance for the return spring and might e.g. avoid any buckling of the return spring. Within the frame of the invention, the rod is multifunctional. For this purpose, the rod comprises teeth. The forced locking mechanism is built with the teeth. By this measure, in some cases a very compact design and/or a reduction of the required number of components can be achieved.

Generally, it is possible that for any possible operating state of the hand levers the pressure lever extends between the two hand levers. A very compact embodiment and an extension of the options for the cranking or offset of the pressure lever and the design of the kinematic of the toggle lever drive results from another proposal of the invention. For this proposal, the movable hand lever comprises a recess being open towards the fixed hand lever. With the closing movement of the hand levers the pressure lever (completely or only partially) enters into the open recess. To mention only one non-limiting example, it is possible that the hand lever is built with two plates held in a distance in the region of the pressure lever. The recess into which the pressure lever enters with the closing movement of the hand levers is built between these plates. It is also possible that in the region of the pressure lever the fixed hand lever builds a U-shaped cross-section. In this case, the recess into which the pressure lever enters is built between the two parallel legs of the U.

Generally, there are a lot of options for the curvature of the middle axis of the pressure lever. To mention only some non-limiting examples, the pressure lever might comprise a middle axis that is composed of straight pieces inclined against each other or a middle axis with a bended curvature (with or without at least one turning point). For one proposal of the invention, the cranking of the pressure lever increases from the toggle joint towards the rigid hand lever (preferably without any turning point and with continuous increase). In the region of the pivot bearing by which the pressure lever is linked at the fixed hand lever the middle axis builds an angle a of at least 90° with the longitudinal axis of the fixed hand lever.

It is also possible that the curved or bended middle axis of the pressure lever comprises a maximum of the distance of at least 1.5 cm (preferably at least 2 cm or at least 2.5 cm) from a longitudinal axis of the pressure lever (which geometrically connects the toggle joint with the pivot bearing by which the hand lever is linked with the fixed hand lever). The bias of the pressure lever with a bending moment increases when increasing the maximum distance. This is due to the fact that the lever arm of the forces being effective at the linking points of the pressure lever increases with an increase of the distance.

For another embodiment of the invention, an angle between a geometrical connecting axis of the longitudinal axes of the die and the pivot bearing by which the movable hand lever is linked at the pivoting ring and a geometrical connecting axis of the middle of the free end of the fixed hand lever and the die is larger than 50° (in particular larger than 55°, 60° or 65°).

Generally, it is possible that the die built by the crimping plugs is located approximately in the middle between the extensions of the two hand levers into the region of the pliers head. However, for a particular proposal of the invention the die built by the crimping plugs is located eccentrically, namely in the region of a prolongation of the fixed hand lever. By this measure, it is possible that the distance of the linking point of the movable hand lever at the actuation body (in particular at the pivoting ring) from the die can be increased. By this increase the forces transmitted via this linking point have an increased lever arm. Accordingly, in the end it is possible to increase the crimping forces and/or to provide a very compact pliers head.

For another embodiment of the invention, the distance of the pivot bearing by which the movable hand lever is linked at the pivoting ring from the longitudinal axis of the die is 30 mm. The distance of the pivot bearing by which the movable hand lever is linked at the pivoting ring from the toggle joint is 14.5 mm. The distance of the toggle joint from the pivot bearing by which the pressure lever is linked at the fixed hand lever is 80 mm. However, it is also possible that at least one of the distances differs from the mentioned dimensions by 20% at the most (in particular 10% or 5% at the most) (wherein the deviations of the different distances might be the same or different).

For another proposal of the invention, the two hand levers have a distance of 118 mm for opened hand levers at a distance of 30 mm from their free ends. For closed hand levers, the two hand levers have a distance of 41 mm at a position with a distance of 30 mm from their free ends. However, it is also possible that at least one of the distances differs from the above specified distances by 20% at the most (in particular 10% or 5% at the most). This design results in a good manipulation for differing hand spans of users with differing hand sizes.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
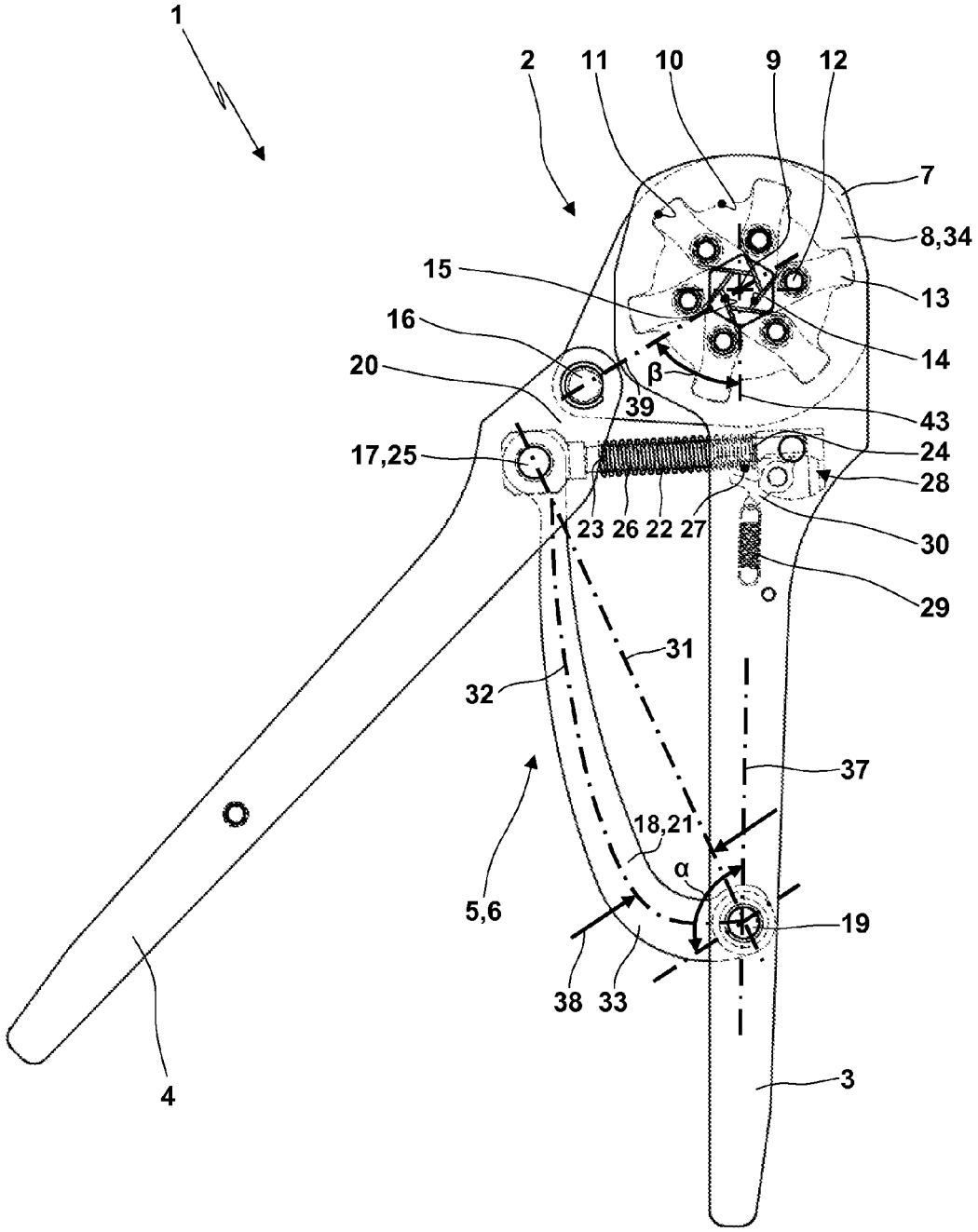
FIG. 1 shows a schematic view of inventive crimping pliers in an opened state.
Figure 2:
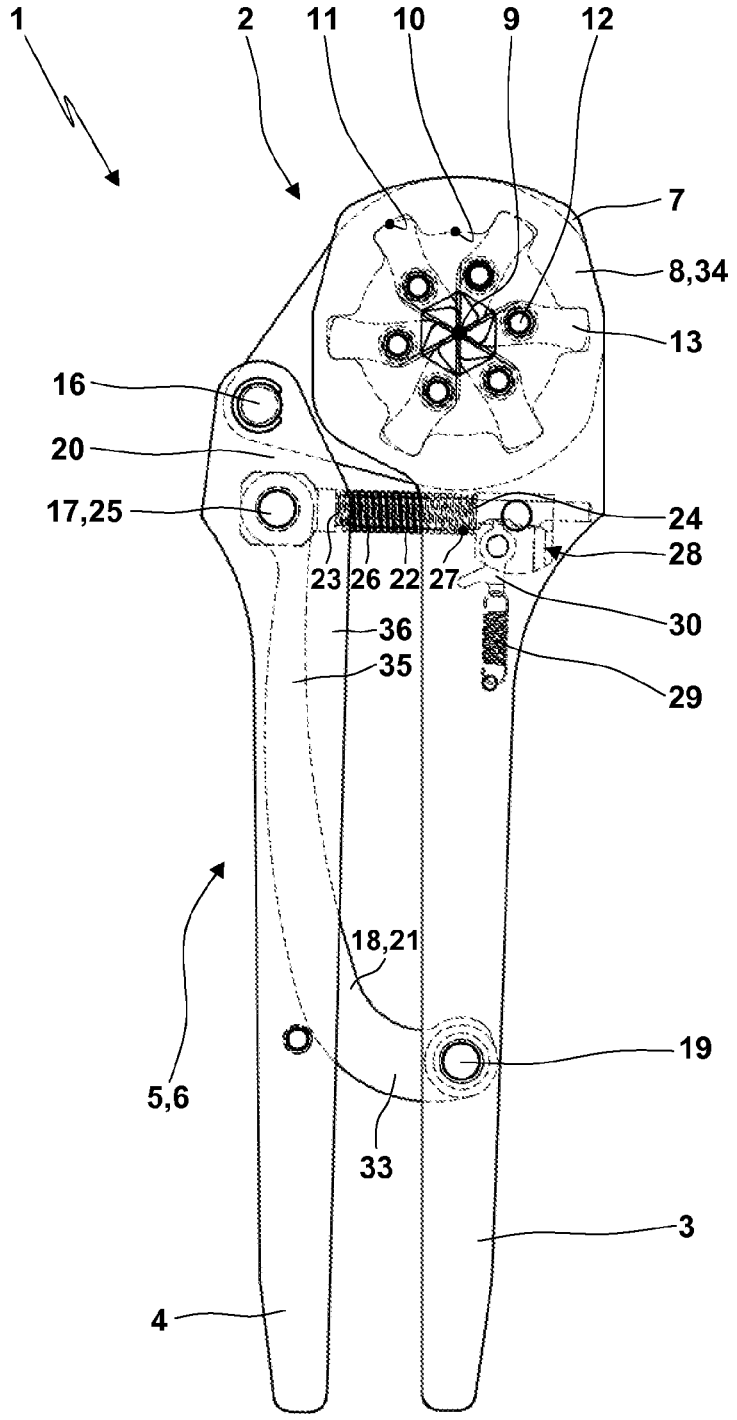
FIG. 2 shows the crimping pliers according to FIG. 1 in a closed state.

In FIGS. 1 and 2 inventive crimping pliers 1 are schematically shown wherein covered invisible edges are shown with dashed lines. It is possible that the crimping pliers 1 are built under use of a plate design.

The crimping pliers 1 comprise a pliers head 2. The actuation of the crimping pliers 1 is done by manual actuation of the hand levers 3, 4. An actuation kinematic 5 is interposed between the hand levers 3, 4 and the pliers head 2. The actuation kinematic 5 is built by a toggle lever drive 6.

For the shown embodiment, the pliers head 2 is built with a base body 7 and an actuation body 8. The base body 7 and the actuation body 8 are built by plates. For the shown embodiment, the actuation body 8 is built by a pivoting ring 34. The base body 7 is fixedly connected with the hand lever 3. Accordingly, the hand lever 3 is also denoted as "fixed hand lever". For the shown embodiment, the base body 7 and the hand lever are integrally built by a plate which is in particular a punched part. In the drawing plane the actuation body 8 is pivotable with respect to the base body 7 around a die axis 9 having an orientation vertical to the drawing plane. The actuation body 8 comprises an end-to-end recess 10 which comprises a circular contour with grooves 11 extending in radial outer direction being regularly distributed in circumferential direction so that a kind of spline profile is built. For the shown embodiment, the actuation body 8 comprises six grooves 11 of this type. Also six pivoting bolts 12 are regularly distributed in circumferential direction around the pivot axis 9. The longitudinal axes of the pivoting bolts 12 have an orientation vertical to the drawing plane of FIG. 1. This pivoting bolts 12 are held by the base body 7. Six crimping plugs 13 are pivotably linked with pivoting bolts 12 for a pivoting movement in the drawing plane. The crimping plugs 13 build a die surface 14 with a radial inner inclined front surface. The die surfaces 14 of the crimping plugs 13 together build a die 15 being generally closed in circumferential direction around the pivoting axis 9. In the present case the cross-section of the die 15 corresponds to a hexagon with unique side lengths. The cross-sectional area of the die 15 decreases with the pivoting movement of the crimping plugs 13 in clockwise direction. In the end region opposite to the crimping surface 14 the crimping plugs 13 are each housed in a respective groove 11. The grooves 11 build a kind of catch or actuator for the crimping plugs 13 so that due to the contact of the afore mentioned end regions of the crimping plugs 13 with the grooves 11 the pivoting movement of the actuation body 18 results in a common pivoting movement of the crimping plugs 13 with the same pivoting angles. Accordingly, in the end with the pivoting movement of the actuation body 8 relative to the base body 7 the cross-sectional area of the die 15 reduces and a workpiece located in the die 15 is crimped.

The design of the pliers head 2 as described above and shown in the figures has been chosen as an example. However, within the frame of the present invention, also differing embodiments of the pliers head might be used, e.g.

- those of the above described prior art,
- embodiments with actuating cams instead of grooves 11,
- embodiments with a moving degree of freedom of the crimping plugs 13 instead of a pivoting guidance and the like.

It is also possible that the pliers head 2 is generally adapted for other crimping processes (e.g. with a differing number of crimping plugs) wherein also only two crimping plugs or die halves might be present and also one of the dies halves might be built by the base body 7 and one die halves might be built by the actuation body 8 and wherein for this embodiment the die halves are not pivoted relative to each other but displaced towards each other in the direction of the crimping stroke.

The relative movement of the actuation body 8 relative to the base body 7 is caused by a toggle lever drive 6. For this purpose, the hand lever 4 is linked with a pivot bearing 16 at the end region facing towards the pliers head 2 at the actuation body 8. For this reason the hand lever 4 is also denoted as "movable hand lever". At a small distance remote from the pivot bearing 16 a pressure lever 18 is linked in a pivot bearing 17 at the hand lever 4. The other end region of the pressure lever 18 is linked at the hand lever 3 in a pivot bearing 19. The pivot bearing 17 builds a toggle joint 25 for a toggle lever 20 which is built by the hand lever 4 in the region between the pivot bearings 16, 17 and for a toggle lever 21 which is built by the pressure lever 18. In the open state according to FIG. 1 the two toggle levers 20, 21 build an obtuse angle (e.g. with an angle in the region of 130°, 140° or 150°±10%). With the closure of the hand levers 3, 4 (cp. FIG. 2) the two toggle levers 20, 21 approximate the stretched or elongated orientation.

For an optional embodiment, the crimping pliers 1 are biased in opening direction by a return spring 22 so that at the end of the overall stroke of the crimping pliers 1 an automatic provision of an opening movement is provided. For the shown embodiment, the return spring 22 is effective between the hand levers 3, 4. Here, a spring base 23 is supported at the toggle joint 25, whereas the other spring base 24 of the return spring 22 is supported at the hand lever 3 (preferably directly adjacent the pliers head 2 or the actuation body 8). The return spring 22 has preferably an orientation approximately vertical to a longitudinal axis 37 of the hand lever 3. For the shown embodiment, a rod 26 extends through the interior of the return spring 22. For the shown embodiment the return spring 22 is built by a spiral spring. The rod 26 is also linked with the toggle joint 25. On its underside the rod 26 comprises teeth 25. A forced locking mechanism 28 is built with the teeth 25 of the rod 26. The forced locking mechanism 28 comprises a latching pawl 30 which is pivotably linked at the hand lever 3 and biased by a spring 29. With the closing movement of the hand levers the latching pawl 30 slides (similar to a ratchet) along the teeth 27 of the rod 26. When temporarily reducing the hand forces applied upon the hand levers 3, 4, by engagement of the latching pawl 30 into the teeth 27 of the rod 26 the latching pawl 30 secures a reached position of the rod 26 in the forced locking mechanism 28. By this measure also the state of the hand levers 3, 4 is secured and the reached closing state of the die 15 is maintained. Accordingly, it is possible to secure a crimping step once reached. Only at a predefined end state of the rod 26 in the forced locking mechanism 28 the locking or latching effect of the forced locking mechanism 28 is removed by an appropriate design of the teeth 27 and the latching pawl 30 so that an opening movement is possible at the end of the crimping process. However, the person with skill in the art will know that the basic principle of the invention is not necessarily linked with the use of a forced locking mechanism, a return spring and/or the use of the rod 26.

Under the assumption that the hand levers 3, 4 and the pressure lever 18 are rigid (for the pressure lever 18 this assumption differs from the inventive design), the closing movement of the hand levers 3, 4 leads to a transfer of the toggle lever drive 6 towards the stretched or elongated orientation. This transfer leads to the consequence that the hand lever 4 applies a force upon the actuation body 8 via the pivot bearing 16 which comprises at least a component in circumferential direction of the die axis 9 and accordingly acts in the direction of closing the die 15. For the above assumption of rigid components, the closed state of the crimping pliers correlates with a fixed predetermined end cross-sectional area of the die 15 which leads to the problems explained in the beginning. To put things right, the invention proposes that the pressure lever 18 is elastically. This covers any elasticity which has the consequence that the application of usual hand forces upon the hand levers 3, 4 result in a deformation of the pressure lever 18 such that due to the deformation the distance of the toggle joint 25 from the pivot bearing 19 changes with a significant extent. In order to mention only some non-limiting examples, the distance of the toggle joint 25 from the pivot bearing 19 might change by at least 0.5 mm, at least 1 mm or at least 1.5 mm. Preferably the inventive feature "wherein the pressure lever is elastically" means that the length of the pressure lever 18 between the toggle joint 25 and the pivot bearing 19 decreases by at least 2 mm (in particular at least 3 mm) when applying hand forces of 280 N upon the hand levers 3, 4. The inventive design of the pressure lever 18 with an elasticity has (dependent from the design of the workpiece located in the die 15, in particular dependent from the cross-section and/or the stiffness of the workpiece) the following consequences for the crimping process:

For a sufficiently small and/or soft workpiece it is possible to completely close the die 15 without any significant deformations of the pressure lever 18. Accordingly, the ratchet-like displacement of the teeth 27 of the rod 26 relative to the latching pawl 30 is caused by the closing movement of the die 15.

For another extreme consideration it is assumed that in the open state according to FIG. 1 the die 15 is completely filled by a workpiece which is completely rigid. In this case, there is (independent from the amount of the force produced by the toggle lever drive 6 and the force transferred to the actuation body 8) no relative pivoting movement of the actuation body 8 relative to the base body 7 and no closing movement of the die 15 possible. Instead, any successive increase of the crimping forces applied upon the hand levers 3, 4 solely leads to an elastic deformation of the pressure lever 18. With a decrease of the distance of the toggle joint 25 from the pivoting bearing 19, the toggle lever drive 6 also moves towards the stretched or elongated state and it is possible that the hand levers 3, 4 move towards each other. This also leads to a ratchet-like relative movement of the teeth 27 of the rod 26 relative to the latching pawl 30. For sufficiently high actuation forces applied upon the hand levers 3, 4 it is possible to run through the entire crimping stroke and to reach the end state defined by the forced locking mechanism 28 without any change of the cross-sectional area of the die 15. When reaching the end state, an opening movement is possible.

For a realistic case under use of the invention, dependent from the size of the workpiece located in the die 15 and its resistance against a deformation there is both a relative movement of the actuation body 8 relative to the base body as well as a deformation of the pressure lever 18. In this case, a relative displacement of the teeth 27 of the rod 26 relative to the latching pawl 30 is caused which is both dependent from the relative pivoting movement of the actuation body 8 relative to the base body 7 as well as dependent from the deformation of the pressure lever 18. The relation of the different contributions to this relative displacement depends on the size of the workpiece and its stiffness: The larger the workpiece and the stiffer the workpiece, the larger is also the component of the deformation of the pressure lever 18 at the relative displacement of the teeth 27 of the rod 26 relative to the latching pawl 30. For the shown embodiment, the pressure lever is built with a thickening in both end regions. In the region of these thickenings bearing eyes are built for providing the toggle joint 25 and the pivot bearing 19. The geometrical connection between the toggle joint 25 and the pivot bearing 19 is denoted as a longitudinal axis 31. Instead, a middle axis 32 denotes a bended or curved axis following the contour of the pressure lever 18. In mechanics the middle axis 32 e.g. denotes the neutral axis of a pressure lever 18 biased by a bending moment or a geometric middle axis of the cross-sectional area.

The pressure lever 18 comprises an offset or cranking 33. Starting from the toggle lever 25, the pressure lever 18 is in the beginning approximately straight or comprises only a slight bending. The bending or cranking continuously increases towards the pivot bearing 19 with an increasing extent. For the shown embodiment, the pressure lever 18 is built (in a rough approximation) in the shape of "hockey stick". Here, the toggle joint 25 is located in the region of the "handle", wherein the pivot bearing 19 is located in the end region of the "ball surface" of the hockey stick. Due to the cranking 33, a force applied by the hand levers 3, 4 upon the pressure lever 18 and being effective along the longitudinal axis 31 leads to the bias of the pressure lever 18 with a bending moment. Besides the afore mentioned thickening, the cross-section of the pressure lever continuously increases from the toggle joint 25 towards the pivot bearing 19.

As can be seen from FIG. 2, for closed hand levers 3, 4 a section 35 of the pressure lever is located with an overlap with the hand lever 4. It is possible that the hand lever 4 is built by two parallel distant plates wherein a recess 36 is built between these two plates. With a closing movement of the hand levers 3, 4 the section 35 of the hand lever 18 enters into the recess 36. However, it is also possible that the hand lever is C-shaped or U-shaped in the cross-section, wherein the recess 36 is then built between the two parallel legs of the C or U. The legs have an orientation such that it is possible that the section 35 enters into the recess 36 during the closing movement. As can be seen from FIG. 2, it is possible that the section 35 entering into the recess 36 is longer than the half of the length of the pressure lever 18.

For the shown embodiment, the bending or cranking of the middle axis 32 is dimensioned such that (at least in the open state shown in FIG. 1) the angle a of the middle axis in the pivot bearing 19 relative to the longitudinal axis 37 of the fixed hand lever 3 is larger than 90°. The curvature of the pressure lever 18 (in particular the bending of the middle axis 32) is chosen such that the maximum of the distance 38 between the middle axis 32 and the longitudinal axis 31 is e.g. at least 1.5 cm (preferably at least 2 cm or at least 2.5 cm).

The geometrical connecting axis 39 of the die axis 9 and the pivot bearing 19 builds an angle b with a connecting axis 43 which connects the free end of the fixed hand lever 3 or its middle with the die axis 9. Preferably, the angle b is larger than 50° (in particular larger than 55°, 60° or 65°).

Figure 3:
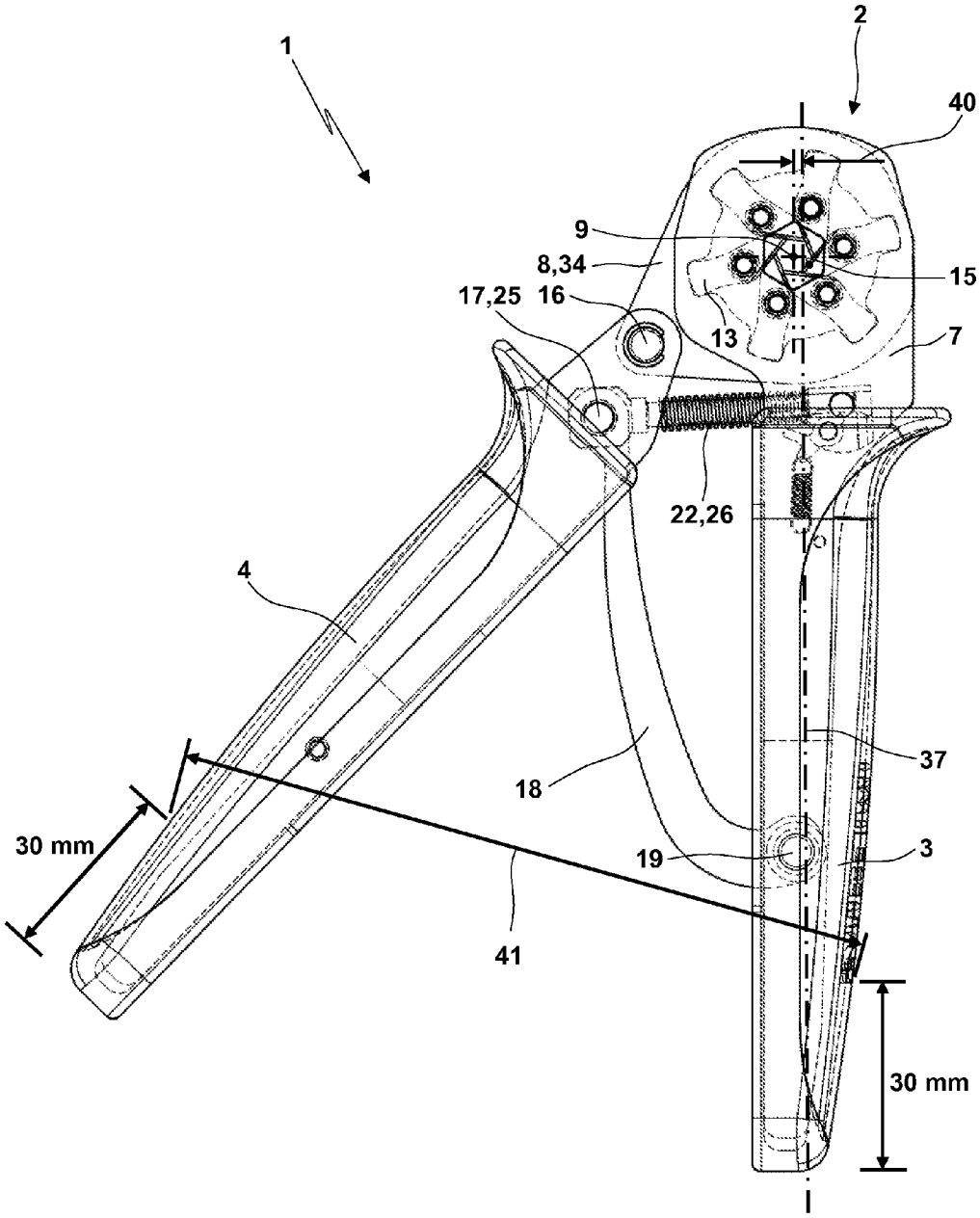
FIG. 3 shows a plane view of a constructive embodiment of crimping pliers in an opened state.
Figure 4:
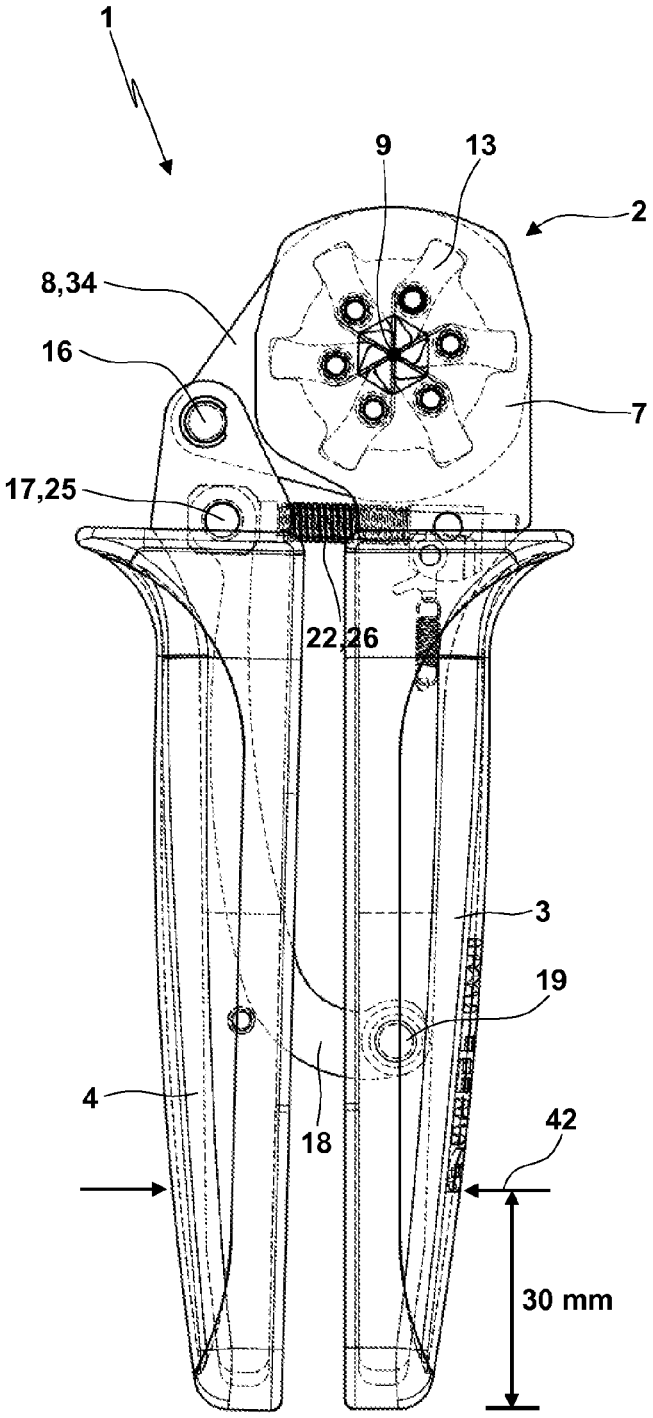
FIG. 4 shows the crimping pliers of FIG. 3 in a closed state.

Preferred geometric properties are shown with crimping pliers according to FIGS. 3 and 4, wherein in FIGS. 3 and 4 also covered edges are shown. The die 15 is approximately located in a prolongation of a longitudinal axis 37 of the hand lever 3. At the maximum the distance 40 of the die axis 9 from the longitudinal axis 37 is in particular smaller than 8 mm (in particular smaller than 5 mm or 3 mm).

In the opened state of the hand levers 3, 4 according to FIG. 3, at a position with a distance 30 mm from their free ends the hand levers 3, 4 have a distance 41 of 118 mm. The corresponding distance according to FIG. 4 is only 41 mm. However, it is also possible that one of the mentioned distances 41, 42 differs from the above specified dimensions by a maximum of 20% (in particular a maximum of 10% or 5%).

According to the embodiments shown in FIGS. 3 and 4, in the region biased by the hand of the user the hand levers 3, 4 made of metal are each housed in a housing body made of plastic which is adapted in its contour and elasticity for the contact with the hands of the user. As can be seen in FIG. 4, also for this embodiment with the closing movement of the hand levers a section 35 enters into a recess 36 of the hand lever 4 (and the housing body made of plastic).

For providing a good transmission ratio of the hand forces for the crimping pliers 1, the angle between the connecting axis 39 and a connecting axis of the pivot bearing 16, 19 should (at least when approaching the closed state of the hand levers 3, 4) be approximately 90°, wherein this angle might also differ by ±5° (e.g. ±3°) from 90°.

The pivot bearing 19 is located in the lower half of the hand lever (measured from the pliers head 2). The pivot bearing 19 is e.g. located at a distance of less than 7 cm (e.g. less than 6 cm or less than 5 cm) from the free end of the hand lever 3.

During the closing movement of the hand lever the movement of the pivot bearing 16 is approximately 5.5 mm (without significant deformation of the pressure lever 18). Here, the hand span should make a path of approximately 80 mm at a position 30 mm from the ends of the hand levers 3, 4. From the two afore mentioned requirements (namely the path of the pivot bearing 16 and the path of the hand span) in some circumstances results that the distance of the pivot bearings 16, 17 is approximately 14.5 mm, whereas the distance of the pivot bearings 17, 19 is approximately 80 mm, wherein the dimensions might also differ by ±20% (e.g. ±10% or ±5%) from these dimensions.

Many variations and modifications may be made to the preferred embodiments of the invention without departing substantially from the spirit and principles of the invention. All such modifications and variations are intended to be included herein within the scope of the present invention, as defined by the following claims.

For some embodiments the invention provides crimping pliers with alternative or extended options for designing the crimping force-crimping stroke-characteristic and/or with the provision of a force-displacement-compensator for crimping workpieces with differing dimensions.

I claim:

1. Crimping pliers for crimping a workpiece, the crimping pliers comprising:

a) a pliers head comprising a base body and an actuation body, wherein the actuation body is movable relative to the base body for causing a crimping movement, b) a fixed hand lever fixedly connected to the base body, c) a movable hand lever operatively connected to the actuation body, the moveable hand lever comprising a toggle joint, d) a pressure lever pivotably linked to the fixed hand lever at a pivot bearing of the fixed hand lever, e) wherein the movable hand lever is pivotably linked to the pressure lever via the toggle joint, and f) wherein the pressure lever is elastic such that a length of the pressure lever between the toggle joint and the pivot bearing decreases in response to applied hand forces upon the fixed hand lever and the moveable hand lever.

2. The crimping pliers of claim 1, further comprising at least three crimping plugs and a pivoting ring, wherein a) the at least three crimping plugs are movable relative to the base body in a radial inner direction, and b) the actuation body is formed by the pivoting ring being pivotable relative to the base body, wherein the pivoting ring comprises grooves or cam surfaces and wherein the at least three crimping plugs are commonly moved in the radial inner direction by the grooves or cam surfaces when pivoting the pivoting ring.

3. The crimping pliers of claim 1, wherein the pressure lever comprises an offset or cranking.

4. The crimping pliers of claim 1, further comprising a return spring, wherein the return spring biases the fixed hand lever and the movable hand lever in an opening direction.

5. The crimping pliers of claim 3, further comprising a return spring, wherein the return spring biases the fixed hand lever and the movable hand lever in an opening direction.

6. The crimping pliers of claim 4, wherein a) a spring base of the return spring is supported in the region of the toggle joint of the movable hand lever; and b) another spring base of the return spring is supported at the fixed hand lever.

7. The crimping pliers of claim 5, wherein a) a spring base of the return spring is supported in the region of the toggle joint of the movable hand lever; and b) another spring base of the return spring is supported at the fixed hand lever.

8. The crimping pliers of claim 7, further comprising a forced locking mechanism.

9. The crimping pliers of claim 8, further comprising a rod extending through the return spring, wherein the rod comprises teeth and wherein the forced locking mechanism is built with the teeth.

10. The crimping pliers of claim 1, wherein the movable hand lever comprises a recess open towards the fixed hand lever, and wherein with a closing movement of the fixed hand lever and the movable hand lever, the pressure lever partially enters into the recess.

11. The crimping pliers of claim 9, wherein the movable hand lever comprises a recess open towards the fixed hand lever, and wherein with a closing movement of the fixed hand lever and the movable hand lever, the pressure lever partially enters into the recess.

12. The crimping pliers of claim 1, wherein the pressure lever comprises a section which has an orientation parallel to a longitudinal axis of the movable hand lever when the moveable hand lever and the fixed hand lever are in a closed orientation or which is arranged with an overlap with the movable hand lever when the moveable hand lever and the fixed hand lever are in the closed orientation.

13. The crimping pliers of claim 11, wherein the pressure lever comprises a section which has an orientation parallel to a longitudinal axis of the movable hand lever when the moveable hand lever and the fixed hand lever are in a closed orientation or which is arranged with an overlap with the movable hand lever when the moveable hand lever and the fixed hand lever are in the closed orientation.

14. The crimping pliers of claim 3, wherein the offset or cranking of the pressure lever increases from the toggle joint towards the pivot bearing.

15. The crimping pliers of claim 9, wherein the offset or cranking of the pressure lever increases from the toggle joint towards the pivot bearing.

16. The crimping pliers of claim 14, wherein the pressure lever comprises a curved middle axis which a) builds an angle a of at least 90° with the longitudinal axis of the fixed hand lever in the region of the pivot bearing by which the pressure lever is linked at the fixed hand lever and/or b) has a maximal distance of at least 1.5 cm from a longitudinal axis of the pressure lever, wherein the longitudinal axis connects the toggle joint with the pivot bearing by which the pressure lever is linked at the fixed hand lever.

17. The crimping pliers of claim 14, further comprising another pivot bearing, wherein the movable hand lever is operatively connected to the actuation body at the other pivot bearing, wherein the actuation body is movable with respect to the base body about a die axis, and wherein an angle β between a) a connecting axis of the die axis and the other pivot bearing and b) a connecting axis of the middle of a free end of the fixed hand lever and the die axis is larger than 50°.

18. The crimping pliers of claim 16, further comprising another pivot bearing, wherein the movable hand lever is operatively connected to the actuation body at the other pivot bearing, wherein the actuation body is movable with respect to the base body about a die axis, and wherein an angle β between a) a connecting axis of the die axis and the other pivot bearing and b) a connecting axis of the middle of a free end of the fixed hand lever and the die axis is larger than 50°.

19. The crimping pliers of claim 1, further comprising a die located in a prolongation of the fixed hand lever.

20. The crimping pliers of claim 18, further comprising a die located in a prolongation of the fixed hand lever.

21. The crimping pliers of claim 1, further comprising another pivot bearing, wherein the movable hand lever is operatively connected to the actuation body at the other pivot bearing, wherein the actuation body is movable with respect to the base body about a die axis, and wherein a) the distance of the other pivot bearing from the die axis is 30 mm, b) the distance of the other pivot bearing from the toggle joint is 14.5 mm and c) the distance of the toggle joint from the pivot bearing by which the pressure lever is linked to the fixed hand lever is 80 mm or at least one of the distances deviates from the afore mentioned distances by a maximum of 20%.

22. The crimping pliers of claim 20, further comprising another pivot bearing, wherein the movable hand lever is operatively connected to the actuation body at the other pivot bearing, wherein the actuation body is movable with respect to the base body about a die axis, and wherein a) the distance of the other pivot bearing from the die axis is 30 mm, b) the distance of the other pivot bearing from the toggle joint is 14.5 mm and c) the distance of the toggle joint from the pivot bearing by which the pressure lever is linked to the fixed hand lever is 80 mm or at least one of the distances deviates from the afore mentioned distances by a maximum of 20%.

23. The crimping pliers of claim 1, wherein a) an open distance between the moveable hand lever and the fixed hand lever at 30 mm from each respective free end is 118 mm when the fixed hand lever and the moveable hand lever are in an open configuration, b) whereas a closed distance between the moveable hand lever and the fixed hand lever at 30 mm from each respective free end is 41 mm when the fixed hand lever and the moveable hand lever are in a closed configuration or at least one of the distances deviates from the afore mentioned distances by a maximum of 20%.

24. The crimping pliers of claim 22, wherein a) an open distance between the moveable hand lever and the fixed hand lever at 30 mm from each respective free end is 118 mm when the fixed hand lever and the moveable hand lever are in an open configuration, b) whereas a closed distance between the moveable hand lever and the fixed hand lever at 30 mm from each respective free end is 41 mm when the fixed hand lever and the moveable hand lever are in a closed configuration or at least one of the distances deviates from the afore mentioned distances by a maximum of 20%.

* * * * *